US009604244B2

(12) United States Patent
Herre

(10) Patent No.: US 9,604,244 B2
(45) Date of Patent: Mar. 28, 2017

(54) COATING DEVICE AND ASSOCIATED OPERATING METHOD

(71) Applicant: Durr Systems GmbH, Bietigheim-Bissingen (DE)

(72) Inventor: Frank Herre, Oberriexingen (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 0 days.

(21) Appl. No.: 14/503,708

(22) Filed: Oct. 1, 2014

(65) Prior Publication Data

US 2015/0013605 A1 Jan. 15, 2015

Related U.S. Application Data

(63) Continuation of application No. 12/300,741, filed as application No. PCT/EP2007/003874 on May 2, 2007, now Pat. No. 8,875,647.

(30) Foreign Application Priority Data

May 15, 2006 (DE) ..... 10 2006 022 570

(51) Int. Cl.
*B05C 5/02* (2006.01)
*B05B 12/14* (2006.01)
(Continued)

(52) U.S. Cl.
CPC ..... *B05C 5/0225* (2013.01); *B05B 12/1409* (2013.01); *F04C 11/001* (2013.01);
(Continued)

(58) Field of Classification Search
None
See application file for complete search history.

(56) References Cited

U.S. PATENT DOCUMENTS 3,924,806 A 12/1975 Schowiak
4,400,147 A * 8/1983 Springer et al. ..... 418/206.4
(Continued)

FOREIGN PATENT DOCUMENTS

DE 3641416 6/1988
DE 69622407 3/2003
(Continued)

OTHER PUBLICATIONS

English translation of DE 10358646.*
(Continued)

*Primary Examiner* — Charles Capozzi
(74) *Attorney, Agent, or Firm* — Bejin Bieneman, PLC

(57) ABSTRACT

A coating device, e.g., for painting motor vehicle bodies, comprises a sprayer for applying a coating material by means of an application element and an internal color-changer valve assembly, said assembly having several color inlets for selecting coating materials of different colors. The internal color-changer valve assembly is integrated into the sprayer and is connected by its outlet to the application element, in order to feed the selected coating material to the application element. Further, an external color-changer valve assembly has several color inlets for selecting coating materials of different colors, said external color-changer assembly having a separate structure from the sprayer and being connected by its outlet to the application element, in order to feed the selected coating material to the application element. An operating method corresponds to the device.

18 Claims, 11 Drawing Sheets

(51) Int. Cl.

| | |
|---|---|
| ***F04C 11/00*** | (2006.01) |
| ***F04C 14/06*** | (2006.01) |
| ***F04C 15/00*** | (2006.01) |
| *F04C 2/18* | (2006.01) |

(52) U.S. Cl.
CPC ..... *F04C 14/065* (2013.01); *F04C 15/0073* (2013.01); *F04C 2/18* (2013.01)

(56) References Cited

U.S. PATENT DOCUMENTS

| | | | | |
|---|---|---|---|---|
| 4,714,179 | A * | 12/1987 | Otterstetter | B05B 12/14 118/302 |
| 4,728,034 | A | 3/1988 | Matsumura et al. | |
| 4,792,092 | A | 12/1988 | Elberson et al. | |
| 4,919,333 | A * | 4/1990 | Weinstein | 239/223 |
| 5,058,812 | A * | 10/1991 | Cox | B05B 5/16 118/629 |
| 5,378,130 | A | 1/1995 | Ozeki et al. | |
| 5,676,756 | A * | 10/1997 | Murate | B05B 3/1057 118/302 |
| 6,688,498 | B1 * | 2/2004 | McGuffey | 222/333 |
| 6,857,860 | B1 | 2/2005 | Zimmermann et al. | |
| 2005/0029368 | A1 * | 2/2005 | Giulano | B05B 12/1409 239/548 |
| 2008/0118652 | A1 * | 5/2008 | Ageorges | B05B 12/1481 427/421.1 |

FOREIGN PATENT DOCUMENTS

| | | | | |
|---|---|---|---|---|
| DE | 10157966 | | 6/2003 | |
| DE | 69722155 | | 5/2004 | |
| DE | 10335358 | | 3/2005 | |
| DE | 10342643 | | 4/2005 | |
| DE | 10358646 | A1 * | 7/2005 | B05B 7/0408 |
| DE | 102004033619 | | 2/2006 | |
| DE | 102004038017 | | 3/2006 | |
| EP | 0184933 | A2 | 6/1986 | |
| EP | 0373749 | A1 | 6/1990 | |
| EP | 0850693 | | 7/1998 | |
| EP | 1502657 | A2 | 2/2005 | |
| EP | 1502658 | | 2/2005 | |
| FR | WO 2006005860 | A1 * | 1/2006 | B05B 12/1481 |
| GB | 2084048 | | 4/1982 | |
| GB | 2416720 | | 2/2006 | |
| SU | 1430113 | A1 | 10/1988 | |
| SU | 1479128 | A1 | 5/1989 | |
| SU | 1659116 | A1 | 6/1991 | |
| WO | 84/01312 | A1 | 4/1984 | |
| WO | 2006004601 | | 1/2006 | |
| WO | 2006005860 | A1 | 1/2006 | |

OTHER PUBLICATIONS

English translation of WO 2006005860.*

Dr. Laible , Richard u.a., Umweltfreundliche Lackiersysteme fur die industrielle Lackierung, 1989, expert Verlag, Ehningen, S.55 (English Abstract included).

Domnick, Joachim, u.a., Oversprayarme Spritztechnik, Metalloberflache, Jan. 1997, S. 43-45 (English Abstract included).

International Search Report for PCT/EP2007/003874 dated Aug. 17, 2007.

* cited by examiner

COATING DEVICE AND ASSOCIATED OPERATING METHOD

CROSS REFERENCE TO RELATED APPLICATIONS

This application is continuation of U.S. application Ser. No. 12/300,741, filed on Nov. 13, 2008, which is a National Stage of PCT/EP2007/003874, filed on May 2, 2007, which claims priority to DE 102006022570.8, filed on May 15, 2006, which prior applications are each hereby incorporated herein by reference in their entireties.

BACKGROUND

The invention relates to a coating device, in particular for painting motor vehicle bodies, and to a corresponding operating method in accordance with the preamble to the subclaims.

In modern painting systems for the mass painting of motor vehicle bodies, painting is usually by means of atomisers (e.g. high-speed rotary atomisers) with only one paint inlet, which are therefore connected to a separate colour changer on the inlet side, so that one single atomiser can apply paint in different colours. The entire train of pipes between the colour changer and the atomiser must be flushed out when the colour is changed, to clear paint residue from the train of pipes. Firstly, this causes colour change losses in the range of 25-70 ml (depending upon the embodiment), which may even exceed 100 ml in exceptional cases, and, secondly, the time required for a colour change, in the range of 8-20 seconds is an irritation, although times of 13-15 seconds are usually achieved. The necessary colour change time depends on the flushability of the paints used, the flushing agent used, the pressure of the media, the structure of the paint-handling components and the position of the components in the application device.

Atomisers with an integrated colour changer (ICC) are also known, for example from EP 1 502 658 A1. The advantage of such known atomisers with an integrated colour changer is the low volume of the train of pipes between the integrated colour changer and the application element (e.g. a bell plate), which advantageously entails lower colour change losses and a short colour change time. However, the fact that the possible number of colours is limited, because the space available for installation in the atomiser is restricted, is a disadvantage of known atomisers with an integrated colour changer.

Different painting systems, variously having an internal or external colour changer, are known from DE 697 22 155 T2, DE 696 22 407 T2, DE 103 42 643 A1, EP 1 502 658 A1, DE 101 57 966 A1, WO 2006/004601 A1, DE 103 35 358 A1, Dr. Richard Laible: "Umweltfreundliche Lackiersysteme fur die industrielle Lackierung" [*Environmentally-friendly painting systems for industrial painting],* 1989, expert Verlag, Ehningen, p. 55; Joachim Domnick: "Oversprayarme Spritzlackiertechnik" [*Low-overspray paints praying systems*], Metalloberflache [Metal Surfaces] 1/1997, pp. 43-45, DE 10 2004 038 017 A1, DE 10 2004 033 619 A1 and DE 36 41 416 A1. However, the external colour changer only has one paint outlet and is not configured as an A/B colour changer. If feeding low runners through the external colour changer, the problem therefore arises that a relatively long colour change time is required when changing from one low runner to another.

SUMMARY

The invention is therefore based upon the problem of creating a correspondingly improved coating device which is particularly suitable for painting motor vehicle bodies and attachments.

This problem is solved by a coating device and a corresponding operating method in accordance with the subclaims.

The invention includes the general technical teaching that both an internal colour-changer valve assembly integrated into the atomiser and an external colour-changer valve assembly structurally separate from the atomiser and preferably configured as an A/B colour changer, must be provided in a coating device.

The colour-changer valve assembly, which is integrated in the atomiser, here is preferably used for colours applied frequently (high runners), as the colour-changing time and the colour-changing losses are extremely low when changing colour using the integrated colour-changer valve assembly.

In contrast, the separate external colour-changer valve assembly is preferably used for colours applied less frequently (lowrunners), as a colour change using the external colour-changer valve assembly is associated with greater colour-change losses, due to the longer train of pipes between the external colour-changer valve assembly and the application element, and demands a longer colour-change time. The average paint consumption/loss of the system is significantly reduced by the combination of high runners and low-runners.

In a preferred embodiment of the invention, the atomiser has at least one additional paint inlet, to which the external colour-changer valve assembly is connected, in addition to the paint inlets of the internal colour-changer valve assembly.

However, as an alternative, it is also possible for the external colour-changer valve assembly to feed a paint inlet of the internal colour-changer valve assembly, so that the external colour-changer valve assembly and the internal colour-changer valve assembly are in series.

In a preferred embodiment, the external colour-changer valve assembly is configured as an A/B colour changer with two separate, flushable paint outlets. Accordingly, the atomiser has at least two corresponding additional paint inlets to which both the paint outlets of the external colour-changer valve assembly are connected, in addition to the paint inlets of the internal colour-changer valve assembly. Colour-change losses and the colour change time are also minimised by the two separately-flushable paint outlets of the external colour-changer valve assembly in the case of the external colour-changer valve assembly, and brought up to the standard of the above-mentioned ICC.

At least one recirculation valve is provided here, permitting a flushing cycle in one channel (e.g. consisting of emptying under pressure, flushing, filling or pressure-feeding the next coating agent, compression in the recirculation pipe, i.e. sludge-thinner recirculation) during the painting process in the other channel. In an embodiment of the external colour-changer valve assembly configured as an A/B colour changer, two recirculation valves are preferably provided, facilitating recirculation for each paint outlet of the external colour-changer valve assembly and thus a flushing cycle. The recirculation valves may be located in the atomiser or outside it. Locating the recirculation valves in the atomiser facilitates flushing into the atomiser, whilst in case of a recirculation valve outside the atomiser, the flushing only takes place up to the recirculation valve being arranged there.

However, there is also an alternative possibility that the external colour-changer valve assembly has only one paint outlet, which is associated with lower investment costs, a smaller installation space and lower weight. In this version, high- and low-runners are preferably applied alternately, so that the internal colour-changer valve has enough time to flush the external colour-changer valve assembly and apply the next low runner to it under pressure during the application of a high runner.

The colour-changer valve assembly integrated into the atomiser is preferably fed with the coating materials of different colours by a first metering device, which is preferably structurally separate from the atomiser.

In a painting robot, the first metering device is preferably mounted on the so-called "arm 1" of the painting robot which is its proximal arm. However, as an alternative, it is also possible for the first metering device for the colour-changer valve assembly integrated into the atomiser to be located on the so-called "arm 2" of the painting robot, which is its distal arm. Moreover, it is possible for the first metering device for the colour-changer valve assembly integrated into the atomiser to be mounted on a frame of the painting robot, where the frame can be moveable along a track (axis 7) and contains a pivot (axis 1), permitting rotation about the Z coordinate. It is also possible for the first metering device for the integrated colour-changer valve assembly to be mounted stationary in or outside a painting cabin, although this is more difficult in most cases.

Furthermore, paint from the external colour changer valve assembly is usually fed to the application element by a second metering device, which may be configured conventionally and therefore need not be described in more detail.

It is possible for the external colour-changer valve assembly and/or the second metering device allocated thereto to be mounted on the so-called "arm 1" or on the so-called "arm 2" of the painting robot. The above-mentioned components are therefore preferably mounted in the immediate vicinity of the atomiser and therefore preferably on "arm 2".

In a preferred embodiment of the invention, the first metering device and/or the second metering device take the form of a geared pump, itself known from prior art, for example from DE 600 09 577 T2.

The geared pump preferably has a plurality of pumping chambers, each with an internal pair of gearwheels, arranged so that they will rotate, where the individual pumping chambers each supply one paint inlet of the atomiser with the respective coating agent. Furthermore, the geared pump preferably also has a common drive shaft to drive the individual geared pumps, which is not the case with the above-mentioned known geared pump. The inventive structure of the geared pump with a plurality of pumping chambers is worthy of independent protection, so that this application is for protection for this design of a geared pump even without the characteristics of the inventive coating device described above.

It is also advantageous for the inventive geared pump to have a common drive shaft to drive the individual gearwheels in the individual pumping chambers of the geared pump, facilitating drive by a single motor.

It is also advantageous for the geared pump to have a plurality of clutches, permitting selective engagement of the drive shaft with the individual pairs of gearwheels. The individual clutches can thus engage the respective pair of gearwheels with the drive shaft or disengage them from it.

In the inventive geared pump, the individual pumping chambers are preferably one behind the other in the axial direction of the drive shaft, facilitating compact design of the geared pump. The immediately adjacent pumping chambers can then have a common chamber wall, making a further reduction in the size of the geared pump possible.

Within the scope of the invention, there is also a possibility of the inventive atomiser having two sub-assemblies, separably connected with each other. The first sub-assembly of the atomiser preferably then contains the internal colour-changer valve assembly, whilst the second sub-assembly of the atomiser preferably contains the application element (e.g. a bell plate) and/or a main needle valve. This has the advantage that both sub-assemblies of the atomiser are connected to each other by only a few pipes, so that only minor contamination occurs if the two sub-assembles are separated. In contrast, should the dividing line between the two sub-assemblies run upstream of the internal colour-changer valve assembly, it would be crossed by numerous paint pipes, which would entail considerable contamination if the two sub-assemblies of the atomiser were separated.

From this description it is also evident that the internal colour-changer valve assembly need not necessarily be located in the same sub-assembly of the atomiser as the bell plate and the main needle valve. On the contrary, the internal colour-changer valve assembly may also be located in another sub-assembly of the atomiser within the scope of the invention, for example in a flange assembly, a manifold or an elbow.

It must also be mentioned that the concept of an "atomiser" should be interpreted in general terms, including, for example, rotary atomisers in the form of bell or disc atomisers, and ultrasonic atomisers, air atomisers, airless devices or Airmix devices. Correspondingly, within the scope of the invention, the application element may be a bell plate, a rotary disc or simply a nozzle.

It must also be mentioned that the inventive coating device can apply water-based paint or solvent-based paint, joint sealants e.g. PVC, or powder lacquer, so that the invention is not restricted in terms of the type of coating agent to be applied.

For example, the coating material may be filler, a base coat or clear varnish.

BRIEF DESCRIPTION OF THE FIGURES

Other advantageous embodiments of the invention are characterised in the dependent claims or are evident from the following description of preferred embodiments on the basis of the drawings.

FIG. 1 is a schematic diagram of an inventive painting system which may be used for the mass painting of motor vehicle bodies and their attachments.

Figure 1:
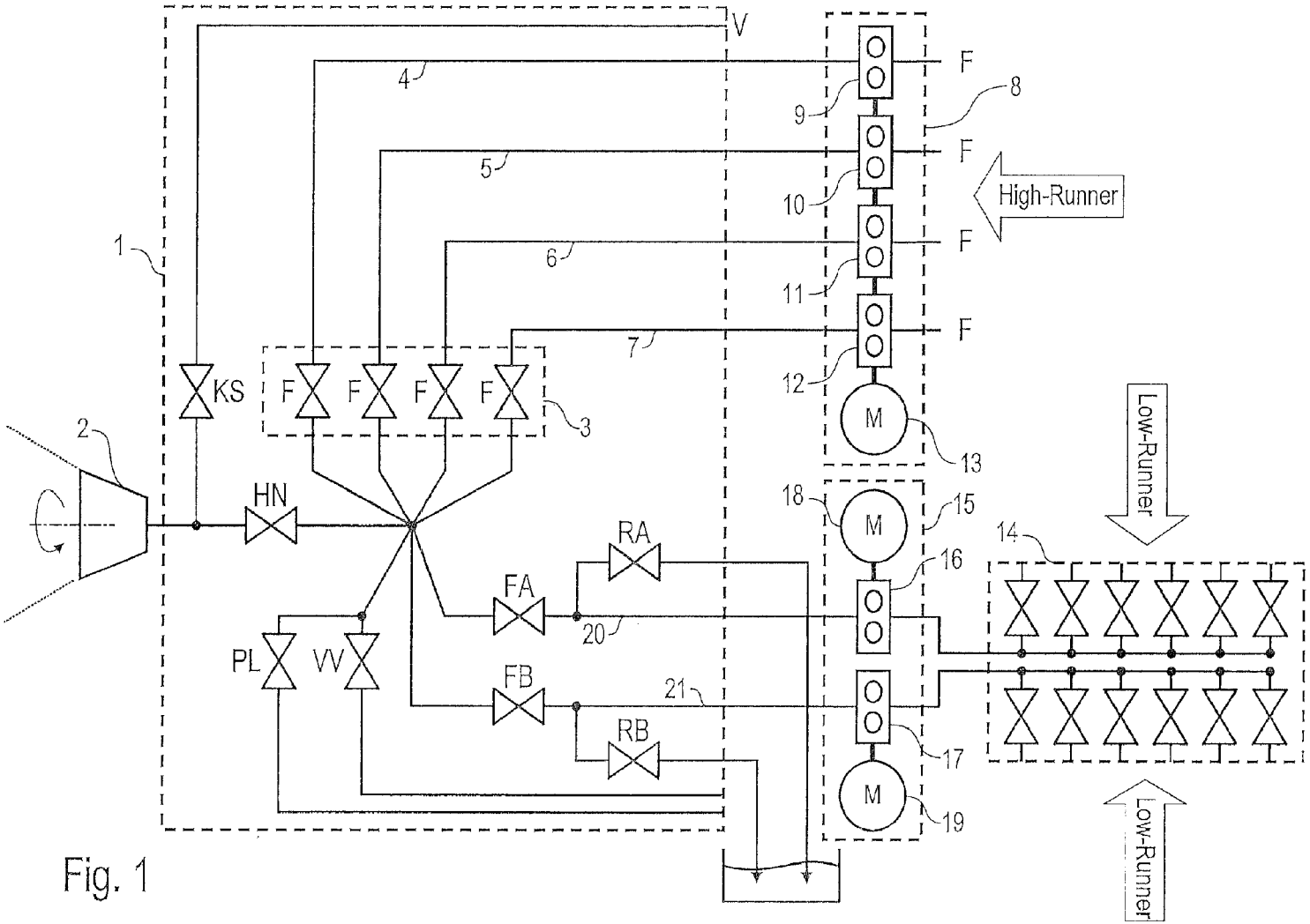
FIG. 1 is a schematic diagram of an inventive coating device with an atomiser with an integrated colour changer and an additional separate colour changer.

For this purpose the inventive coating device has an atomiser 1, which is in the form of a high-speed rotary atomiser in this embodiment and which has a bell plate 2 as an application element.

The atomiser 1 has an integral colour changer valve assembly 3 with four paint valves F1, F2 F3, F4 to supply high runners. The paint valves F1-F4 of the integral colour-changer valve assembly 3 are each connected to a paint inlet 4-7, wherein the paint inlets 4-7 are available on the connecting flange of the atomiser 1.

A metering device 8 is connected to the paint inlets 4-7 of the integral colour-changer valve assembly 3, which is structurally separate from the atomiser 1 and which has a volumetric metering pump 9-12 for each of the paint inlets 4-7 and a common drive motor 13.

The high runners are fed to the metering device 8, as the integral colour-changer valve assembly 3 only has low colour-change losses due to the short train of pipes between the integral colour-changer valve assembly 3 and the bell plate 2, and requires a short colour change time.

The integral colour-changer valve assembly 3 is therefore connected to the bell plate 2 through a common main needle valve HN, which is only shown in diagrammatic form in the drawing.

A short flushing valve KS is also on a branch between the main needle valve HN and the bell plate 2, ending in a flushing connection V on the connection flange of the atomiser 1. The bell plate 2 can be flushed with a known flushing agent through the flushing connection V and the short flushing valve KS.

The common node at the outlet of the integral colour-changer valve assembly 3 and the inlet of the main needle valve HN is also connected to a pulsed air connection provided on the connecting flange of the atomiser 1 through a pulsed air valve PL. The train of pipes of the atomiser 1 can be cleaned with pulsed air through the pulsed air valve PL, which is itself also known.

A flushing agent valve VV also branches off from the common node of the colour-changer valve assembly 3 and the main needle valve HN, ending at the flushing connection V on the connection flange of the atomiser 1, so that conventional solvent flushing is possible through the flushing agent valve VV.

In addition to the colour-changer valve assembly integrated into the atomiser 1, the inventive coating system has a separate colour-changer valve assembly 14 which is structurally separate from the atomiser and which may take a conventional form, as described, for example, in EP 1 502 657 A2. At this point it need only be mentioned that the external colour-changer valve assembly 14 is configured as an A/B colour changer and has two paint outlets which are separately flushable, meaning that the colour changing time and colour changing losses can be reduced.

On the outlet side, the external colour-changer valve assembly 14 is connected to a metering device 15, which has a volumetric metering pump 16, 17 for each of the two paint outlets of the external colour-changer valve assembly 14, whereby the two metering pumps 16, 17 are each driven independently of each other by a drive motor 18, 19.

In addition to the paint inlets 4-7 for the integral colour-changer valve assembly 3, the atomiser 1 has two separate paint inlets 20, 21, which are connected to the main needle valve HN through separately-actuatable paint valves FA, FB, to connect the atomiser 1 to the metering device 15.

The external colour-changer valve assembly 14 is supplied with low runners, for which the longer colour change time and greater colour change losses play a less significant role.

A recirculation valve RA, RB is on a branch off the additional paint inlets 20, 21 for the external colour-changer valve assembly 14, whereby the two recirculation valves RA, RB in this embodiment are structurally integrated into the atomiser 1. In this way the paint inlets 20, 21 can be flushed as far as the atomiser 1.

If high runners account for 65% of total capacity and colour change losses amount to 49 ml in the external colour-changer valve assembly and 5 ml in the internal colour-changer valve assembly 14, the inventive coating device described above facilitates a reduction in average colour change losses from 49 ml to 20.4 ml, corresponding to a saving of 28.6 ml.

Figure 2:
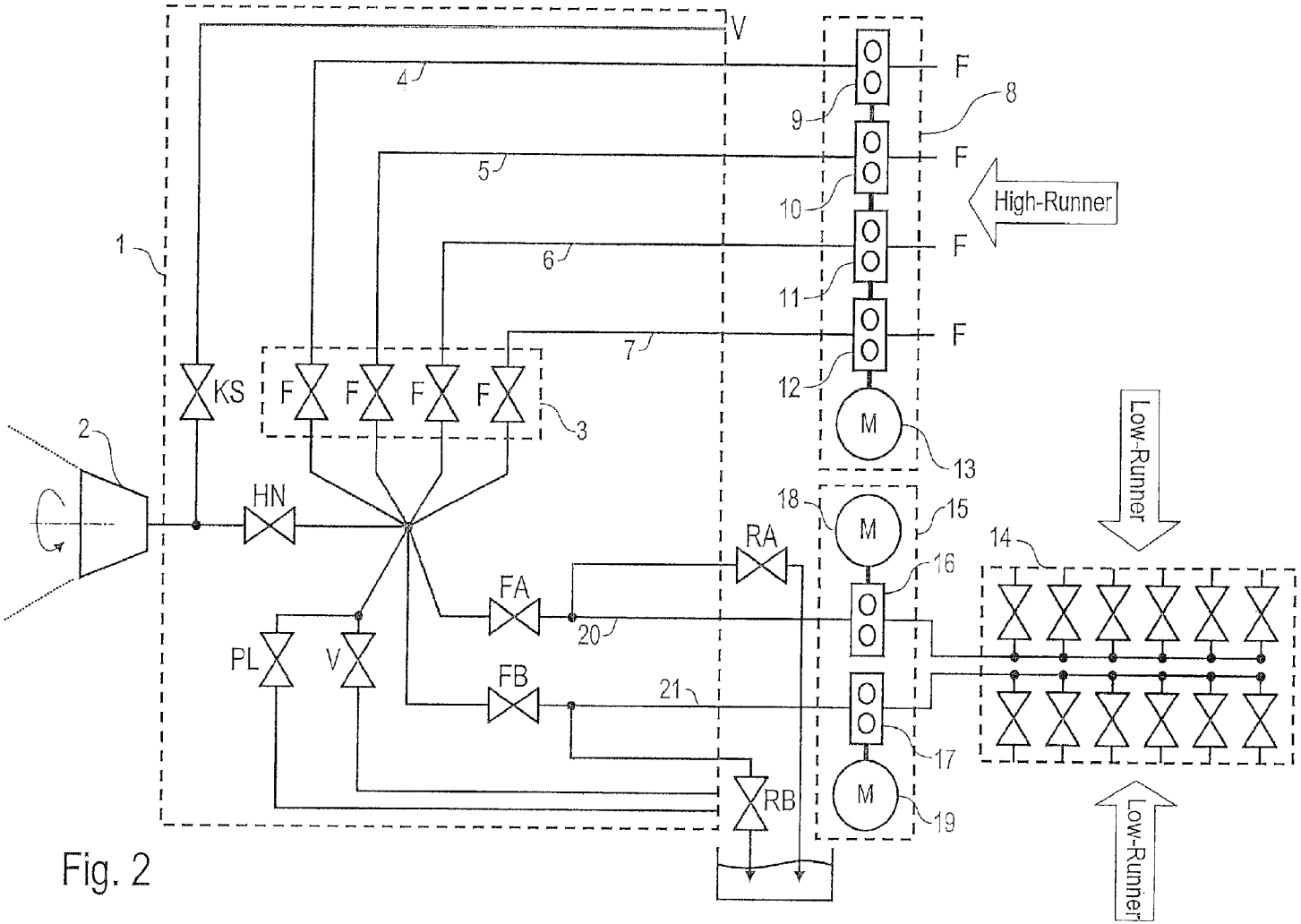
FIG. 2 is a modification of the coating device according to FIG. 1.

FIG. 2 shows a minor modification to the embodiment in FIG. 1, so reference is made to the above description to avoid repetition, whereby the same numbers are used for corresponding components.

A peculiarity of this embodiment is that both the recirculation valves RA, RB are located outside the atomiser 1.

Figure 3:
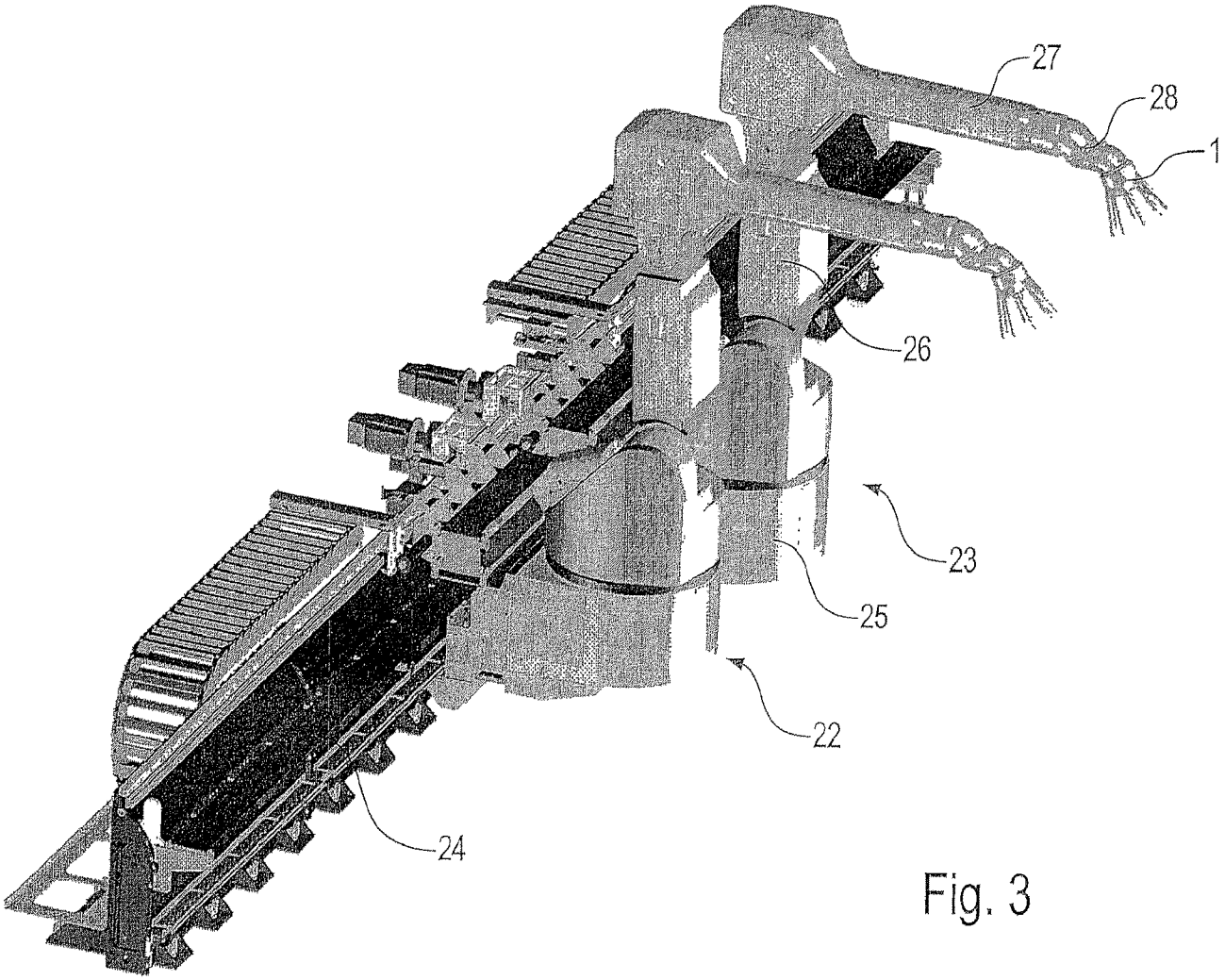
FIG. 3 is a perspective view of an inventive painting robot with the coating device shown in FIG. 1.

FIG. 3 is a perspective view of two painting robots 22, 23, which may be moved linearly along a track 24, which is known. Both the painting robots 22, 23 each have a moveable frame 25 and two robot arms 26, 27, robot arm 26 being designated "arm 1" and robot arm 27 being designated "arm 2".

A conventional robot wrist 28, which guides the atomiser 1, is fitted to the distal end of the robot arm 27.

The metering device 8 (c.f. FIG. 1) for the colour-changer valve assembly 3 integrated into the atomiser 1 is mounted in robot arm 26 ("arm 1"), whilst the external colour-changer valve assembly 14 is mounted in robot arm 27 ("arm 2").

It must also be mentioned that the pulsed air valve PL and the flushing agent valve VV may also be located outside the atomiser 1, for example on robot arm 27 ("arm 2"). The changeover then takes place outside the atomiser 1.

Figure 4:
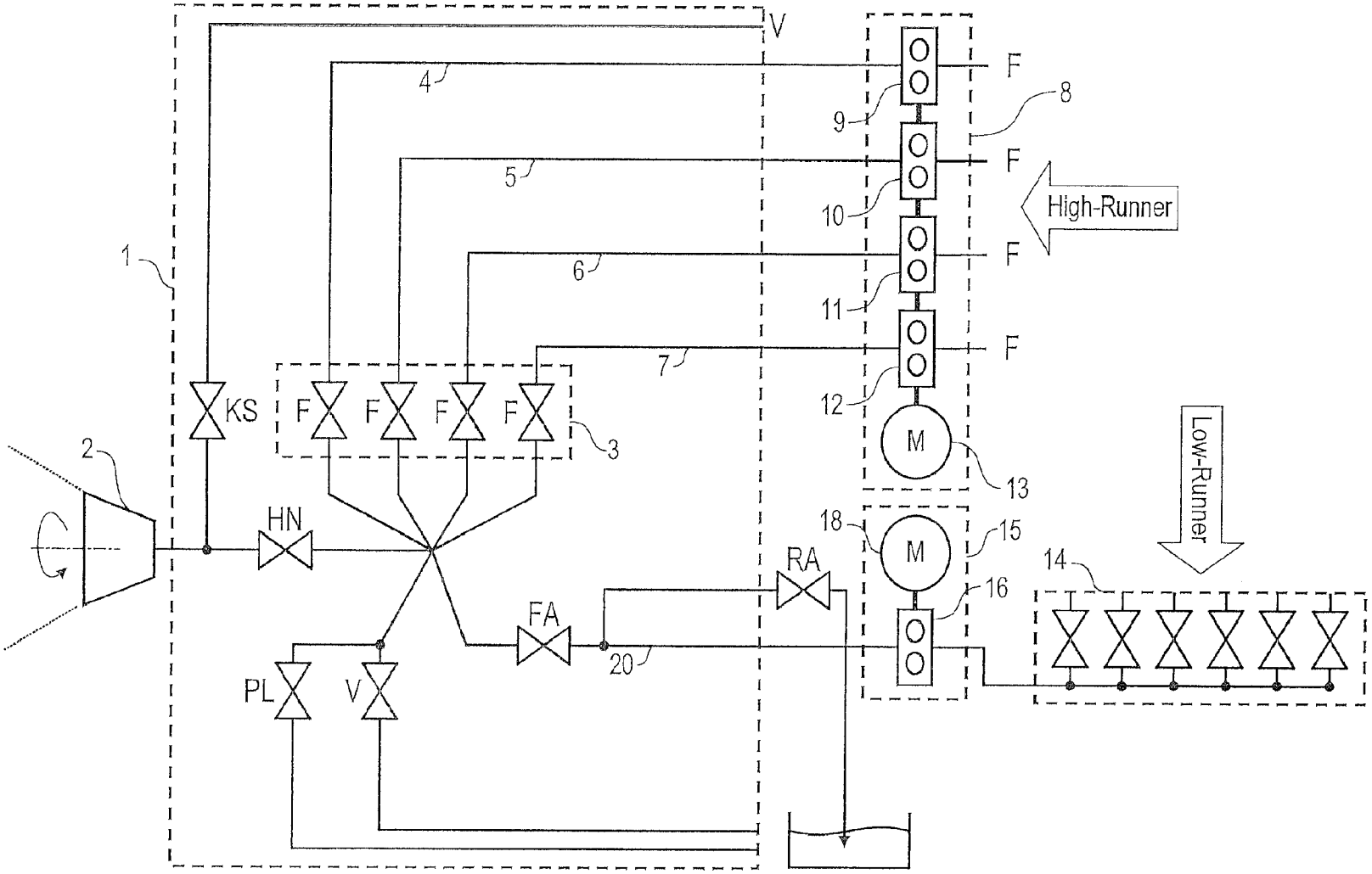
FIG. 4 is a modification of the embodiment according to FIG. 2 with an external colour changer which has only one paint outlet.

FIG. 4 shows a modification to the embodiment in FIG. 2, so reference is made to the above description to avoid repetition, whereby the same numbers are used for corresponding components.

A peculiarity of this embodiment is that the external colour-changer valve assembly 14 is not configured as an A/B colour changer, but has only one paint outlet, which is associated with lower investment costs, a smaller installation space and lower weight.

Figure 5:
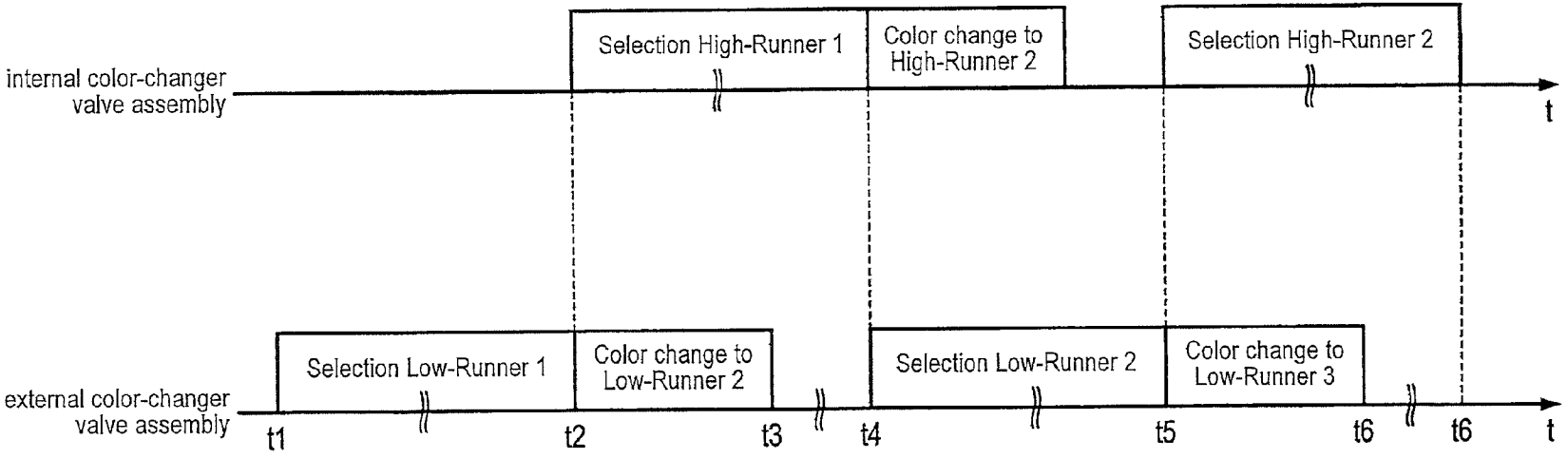
FIG. 5 is a flow chart illustrating the operation of the embodiment in accordance with FIG. 4.

In this version, high-runners and low-runners are applied alternately, as shown in the flow chart in FIG. 5, so that there is enough time during the application of a high runner through the internal colour-changer valve assembly 3 to flush the external colour-changer valve assembly 14 and apply the next low runner to it under pressure. The longer colour changing time required by the external colour-changer valve assembly 14 then has no irritating effect, but production scheduling becomes more involved, in order to ensure that the atomiser 1 can apply high-runners and low runners alternately.

Figure 6A:
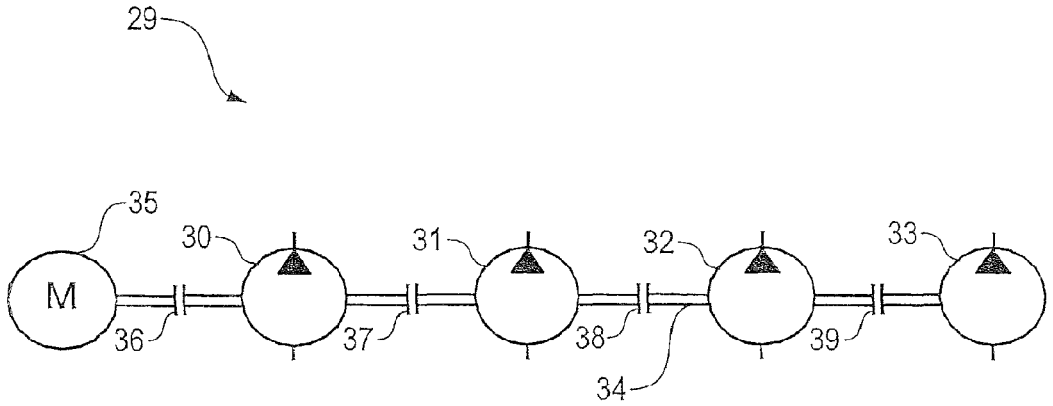
FIG. 6A is a geared pump of conventional design which may be used to supply high-runners or low-runners.

FIG. 6A shows an embodiment of a geared pump 29 which may, for example, be used instead of the metering device 8 in FIG. 1 to supply the various paint inlets 4-7 of the atomiser 1 with the various high runners.

DETAILED DESCRIPTION

The geared pump 29 has a plurality of pumping chambers 30-33, shown only in diagrammatic form here, each of which contains a pair of gearwheels, as is known, for example, from DE 600 09 577 T2.

The individual pairs of gearwheels in pumping chambers 30-33 are driven by a motor 35 through a drive shaft 34. Clutches 36-39, facilitating mechanical disconnection, are located between the individual pumping chambers 30-33 and between the pumping chamber 30 and the motor 35.

Figure 6B:
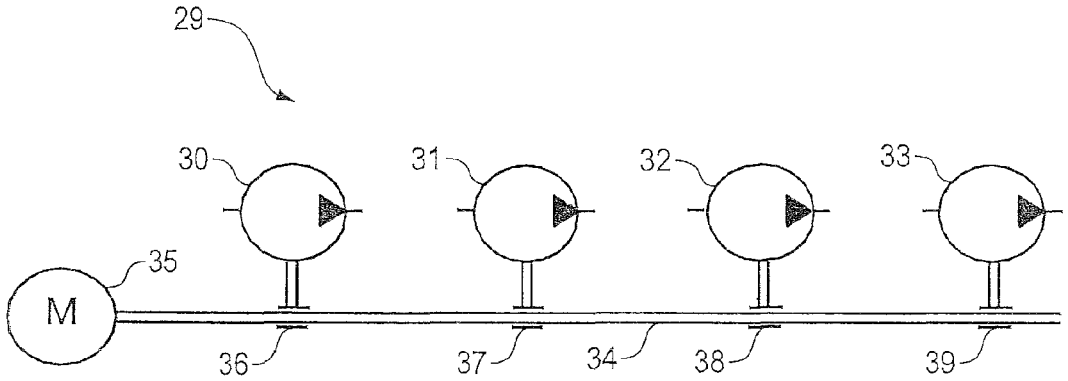
FIG. 6B is a geared pump of novel design, with a plurality of pumping chambers, pairs of gearwheels located therein and a common drive shaft to drive said pairs of gearwheels.

FIG. 6B shows a further, novel embodiment of a geared pump 29, whereby this embodiment is partially identical to that described above and shown in FIG. 6A, so reference is made to the above description of FIG. 6A to avoid repetition, the same numbers being used for corresponding components.

A peculiarity of this embodiment is that the common drive shaft 34 for the pairs of gearwheels located in the individual pumping chambers 30-33 extends through the entire length of the geared pump 29.

The individual clutches 36-39 do not facilitate mechanical disconnection of the drive shaft 34 in an axial direction in this case. Instead, the individual clutches 36-39 make it possible for the pairs of gearwheels located in the pumping chambers 30-33 to be engaged with or disengaged from the drive shaft 34 selectively.

The structural design and method of operation of the geared pump 29 are described in more detail below, using FIGS. 7 to 10.

It is thus evident from these drawings that the individual pumping chambers 30-33 are each formed by a central plate 40-43 and adjacent end plates 44-51, so that the individual pumping chambers 30-33 are behind one another in the axial direction of the drive shaft 34.

Figure 7:
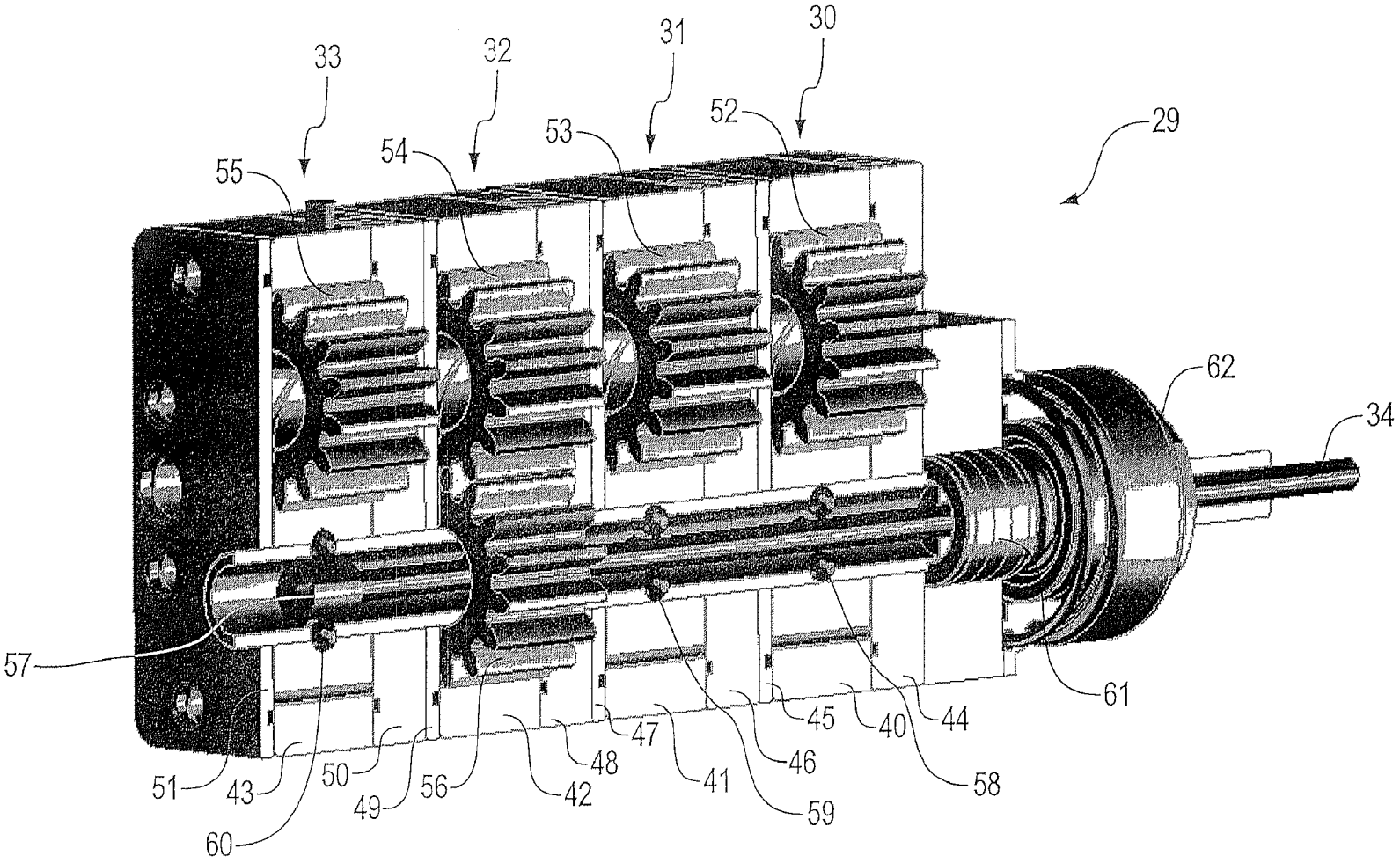
FIG. 7 is a cutaway perspective view of the geared pump in accordance with FIG. 6B.
Figure 8:
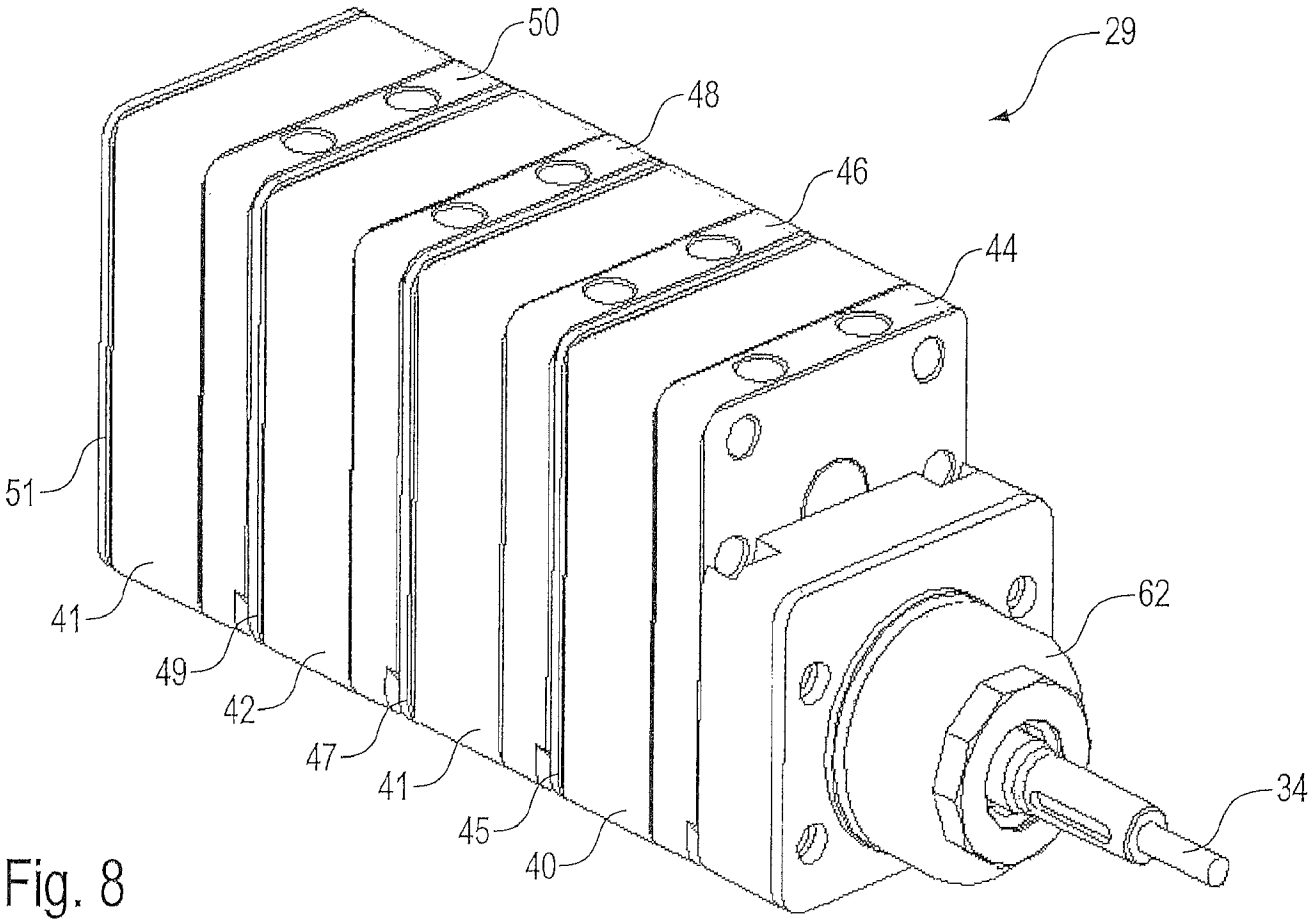
FIG. 8 is a perspective view of the geared pump in FIG. 7.
Figure 9:
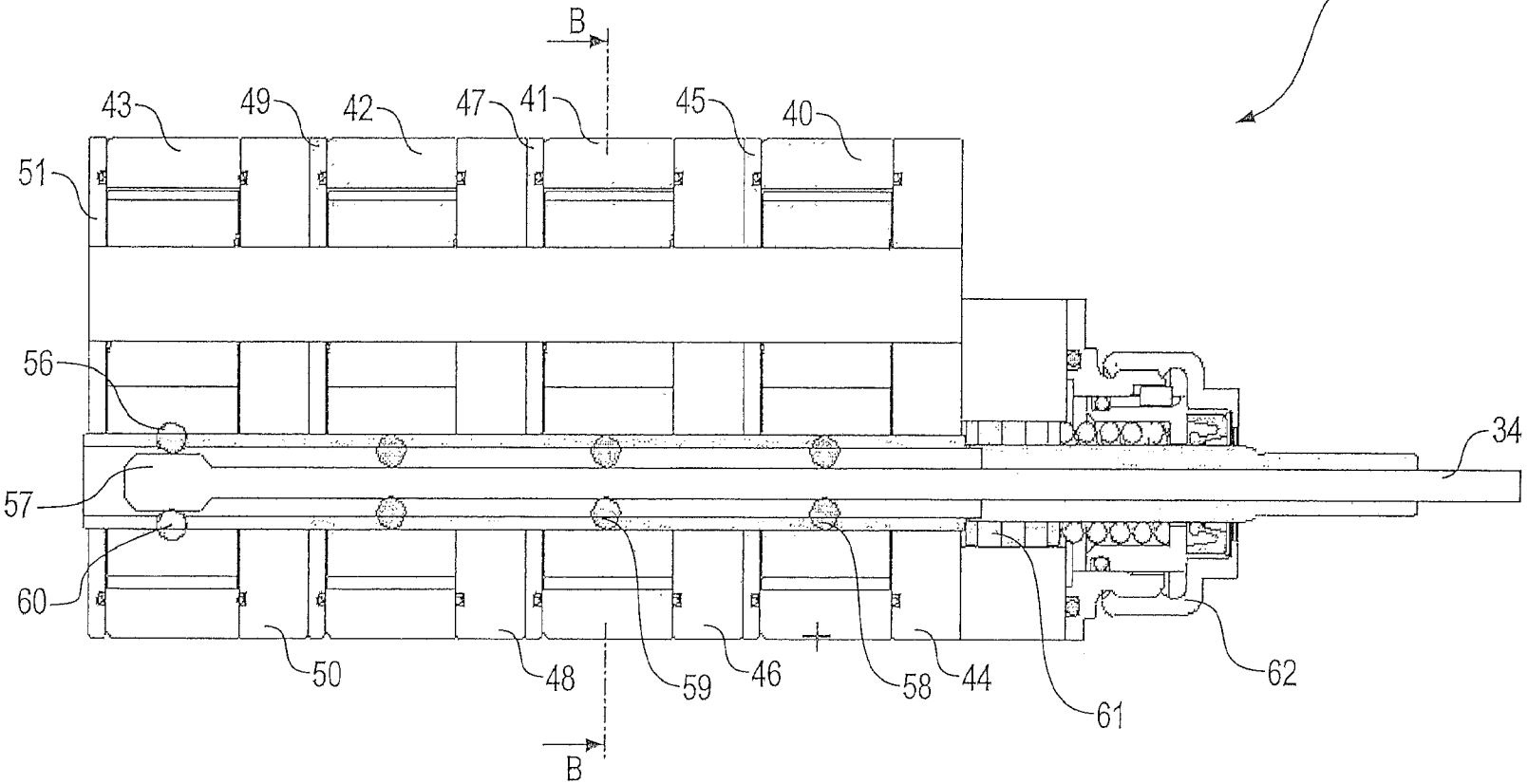
FIG. 9 is a longitudinal section through the geared pump in accordance with FIGS. 7 and 8.
Figure 10:
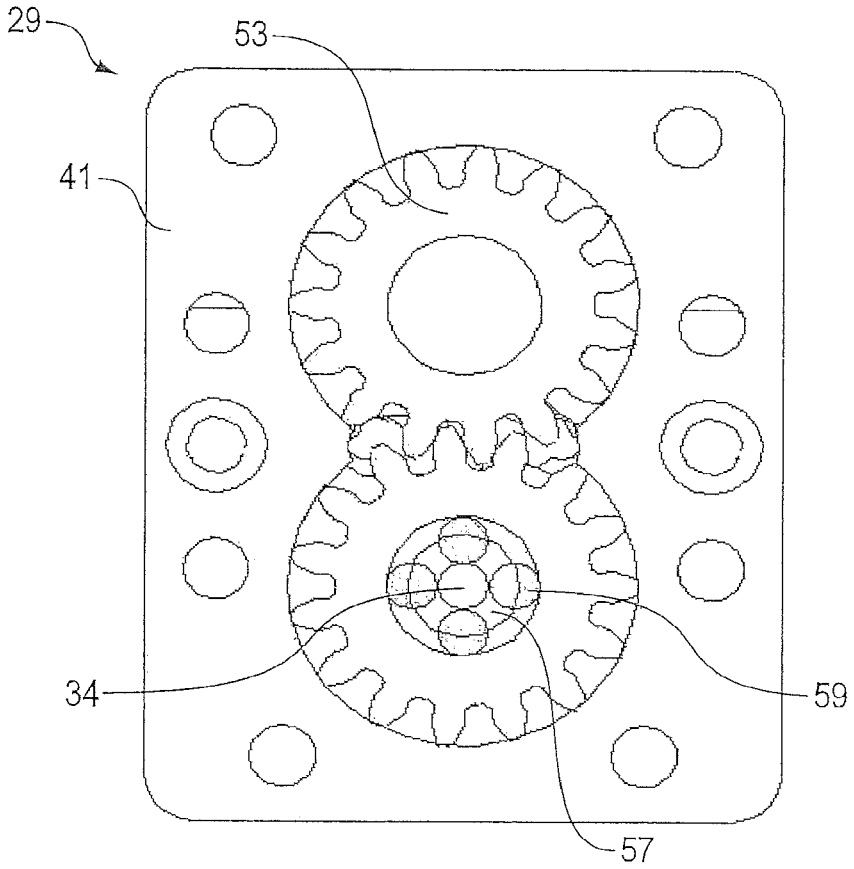
FIG. 10 is a cross-section of the geared pump in accordance with FIGS. 7 to 9 and FIG. 11 is a cross-section through an inventive atomiser with an internal colour-changer valve assembly.

For the sake of simplification, only five gearwheels 52-56 are shown in full in the cutaway three-quarter view in FIG. 7, although two gearwheels engaging with each other are located in each of the pumping chambers 30-33.

In addition, the geared pump 29 has a draw key 57 for selective engagement of the pairs of gearwheels located in the pumping chambers 30-33 with the drive shaft 34, facilitating engagement of the drive shaft 34 with the individual pairs of gearwheels by means of locking elements 58-60.

The geared pump 29 also has a shaft seal 61 and a bearing 62 in this embodiment.

The compact size of this design of the geared pump 29 is advantageous, which is particularly important when the geared pump 29 is to be mounted in a robot arm.

Figure 11:
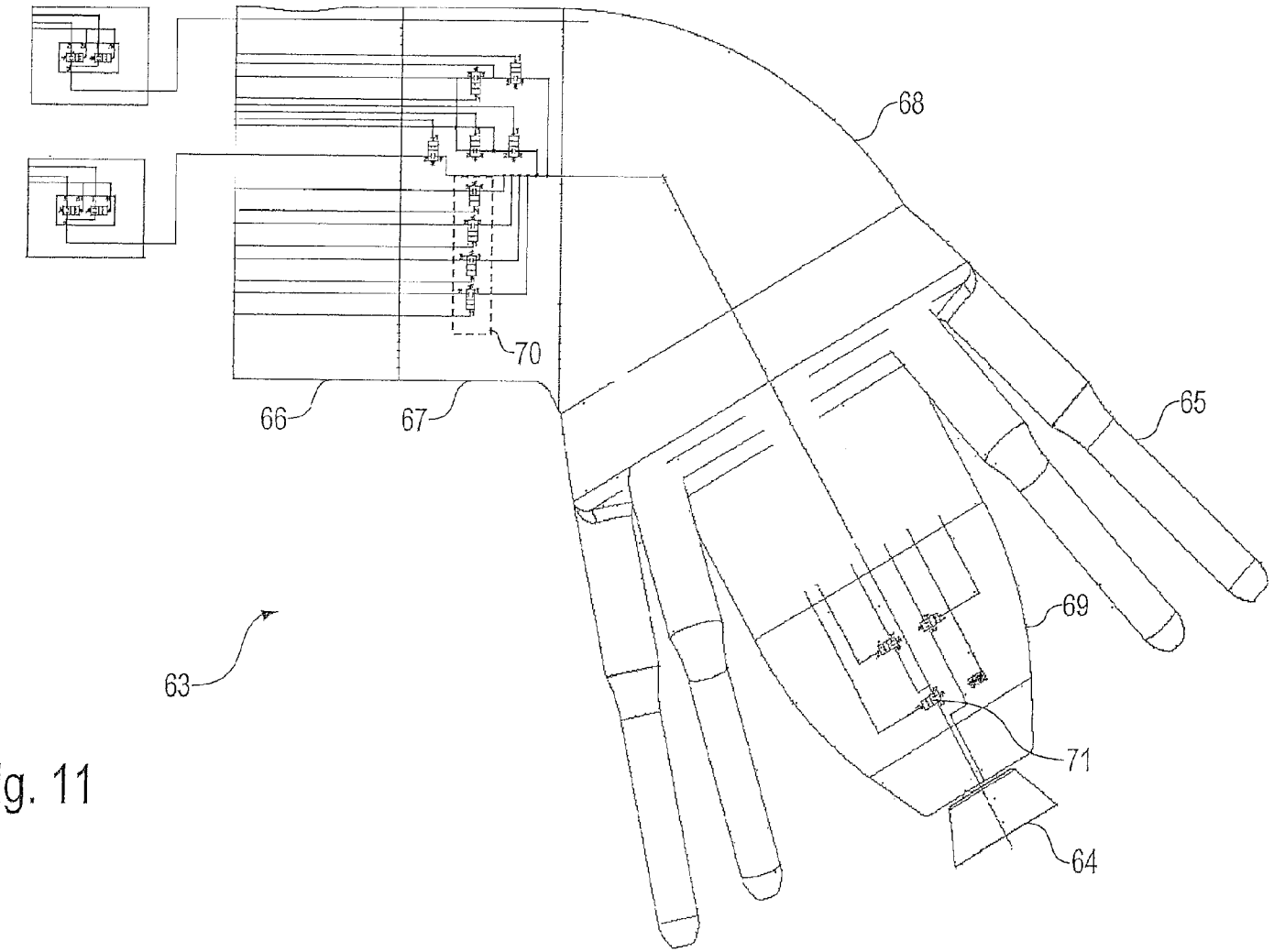

Finally, FIG. 11 is a schematic diagram of an inventive atomiser 63 with a bell plate 64 and a plurality of external electrodes 65 for electrostatic charging of the coating material to be applied.

Here, the atomiser 63 has a flange assembly 66, a manifold 67, an elbow 68 and a forepart 69.

The manifold 67 contains an internal colour-changer valve assembly 70, whilst a main needle vale 71 is located in the forepart 69. This has the advantage that if the manifold 67 is separated from the elbow 68 and forepart 69, only a few pipes will extend across the dividing line, entailing only minor contamination on separation.

The invention is not restricted to the embodiments described above. On the contrary, a variety of alternatives and modifications is possible, also using the inventive concept and therefore being within the scope of protection.

The invention claimed is:

1. A coating device, for painting motor vehicle bodies, comprising:

an atomiser for applying a coating agent by an application element;

an internal color-changer valve assembly to supply high runner paints with a plurality of paint inlets for selecting coating agents of different colors and a high runner paint outlet, where the internal color-changer valve assembly is structurally integrated into the atomiser and directly connected to a main needle valve at the high runner paint outlet end, to supply the application element with the selected coating agent wherein the internal color changer is proximate the main needle valve such that no recirculation valve is positioned downstream from the internal color changer; and an external color-changer valve assembly to supply low runner paints with a plurality of paint inlets for selecting coating agents of different colors and a low runner paint outlet, where the external color-changer valve assembly is structurally separate from the atomiser and the low runner paint outlet is connected to the main needle valve through a first separately actuatable valve, to supply the application element with the selected coating agent; wherein a first recirculation valve is provided, which facilitate recirculation for the lower runner paint outlet of the external color-changer valve assembly.

2. The coating device in accordance with claim 1, wherein the recirculation valve is structurally integrated into the atomiser.

3. The coating device in accordance with claim 1, wherein the recirculation valve is structurally separate from the atomiser.

4. The coating device in accordance with claim 1, wherein a) the internal color-changer valve assembly is fed with coating agents of different colors by a first metering device, and b) a second metering device feeds the coating agents from the external color-changer to the separately actuatable valve.

5. The coating device in accordance with claim 4, wherein the first metering device is structurally separate from the atomiser, and is located on a component selected from the group consisting of:

a) a proximal robot arm of a painting robot, b) a distal robot arm of a painting robot, c) a body of a painting robot, d) a stationary component in a painting cabin, e) a stationary component outside a painting cabin.

6. The coating device in accordance with claim 4, wherein the external color-changer valve assembly and the second metering device allocated thereto are mounted on a component selected from the group consisting of:

a) a proximal robot arm of a painting robot, b) a distal robot arm of a painting robot.

7. The coating device in accordance with claim 4, wherein the first metering device and the second metering device are in the form of a geared pump.

8. The coating device in accordance with claim 7, wherein:

the geared pump has a plurality of pumping chambers, each containing a pair of gearwheels configured to rotate within their respective chambers, the individual pumping chambers each supply paint to at least one of the paint inlets of the atomizer and the internal color-changer valve assembly; and the geared pump has a common drive shaft to drive the individual pairs of gearwheels.

9. The coating device in accordance with claim 8, wherein the geared pump includes a plurality of clutches configured to selectively engage the drive shaft with the individual pairs of gearwheels.

10. The coating device in accordance with claim 8, wherein a) the pumping chambers are behind each other in the axial direction of the drive shaft, and b) the immediately adjacent pumping chambers have a common chamber wall.

11. The coating device in accordance with claim 1, wherein a) the atomiser has a first sub-assembly in which the internal color-changer valve assembly is located;

b) the atomiser has a second sub-assembly with a bell plate application element, and c) the first sub-assembly is separably connected to the second sub-assembly.

12. The coating device in accordance with claim 1, wherein the atomiser is selected from the group consisting of:

a) a rotary atomiser;

b) an ultrasonic atomiser;

c) an air atomiser;

d) an airless device;

e) an airmix device.

13. The coating device in accordance with claim 1, wherein the coating agent is selected from the group consisting of:

a) water-based paint;

b) solvent-based paint;

c) powder lacquer;

d) joint sealant.

14. The coating device in accordance with claim 1, wherein the coating agent is selected from the group consisting of:

a) filler;

b) base coat;

c) clear varnish.

15. The coating device in accordance with claim 8, wherein the respective pairs of gearwheels of each pumping chamber are spaced axially from each other along the driveshaft.

16. The coating device in accordance with claim 8, wherein the plurality of pumping chambers are each spaced axially from each other with respect to the driveshaft.

17. The coating device in accordance with claim 8, wherein the plurality of pumping chambers share a plate, the plate defining a chamber wall of each of the plurality of pumping chambers.

18. The coating device in accordance with claim 8, wherein the driveshaft includes a key disposed within the driveshaft, the key configured to move axially along the driveshaft to selectively engage each of the gearwheels.

* * * * *